United States Patent [19]

Wolters et al.

[11] Patent Number: 4,800,682

[45] Date of Patent: Jan. 31, 1989

[54] GRINDER, ESPECIALLY A HIGH PRECISION GRINDER, FOR A BEARING RING

[75] Inventors: Martin Wolters; Rolf Wilde, both of Wuppertal; Manfred Loock, Sprockhövel, all of Fed. Rep. of Germany

[73] Assignee: Maschinenfabrik Ernst Thielenhaus GmbH, Wuppertal, Fed. Rep. of Germany

[21] Appl. No.: 103,531

[22] Filed: Sep. 30, 1987

[30] Foreign Application Priority Data

Oct. 2, 1986 [DE] Fed. Rep. of Germany ..... 3633531

[51] Int. Cl.[4] ..... B24B 19/06

[52] U.S. Cl. ..... 51/33 W; 51/165.9

[58] Field of Search ..... 51/33 W, 58, 60, 68, 51/291, 165.9

[56] References Cited

U.S. PATENT DOCUMENTS 4,048,764 9/1977 Schmitz ..... 51/291

FOREIGN PATENT DOCUMENTS 1752520 12/1970 Fed. Rep. of Germany .
0130009 3/1978 Fed. Rep. of Germany ..... 51/58
1752064 5/1981 Fed. Rep. of Germany .
3633531 8/1987 Fed. Rep. of Germany .
0237516 11/1971 U.S.S.R. ..... 51/58
0551157 4/1977 U.S.S.R. ..... 51/291

*Primary Examiner*—Frederick R. Schmidt
*Assistant Examiner*—Robert A. Rose
*Attorney, Agent, or Firm*—Herbert Dubno

[57] ABSTRACT

The grinder, especially a high precision grinder, for a ring bearing which has a race with a curved cross section comprises at least one tool support and at least one tool holder. The tool holder is support in the tool support on two equal feed guide rods. A feed piston cylinder device for a feed and a withdrawal motion is provided. The tool support with the tool holder is oscillatable to and fro about a substantially central oscillation axis through the tool support which provides a tool mounted in the tool holder in the working position with a to and fro pivoting motion rotating substantially about the center of the curved cross section of the race. To minimize disturbing vibration the feed guide rods are held and secured at both ends by at least one crosstie bar. The crosstie bars at both ends of the feed guide bars are mass balanced in regard to the pivoting motion. The feed piston cylinder device comprises two mass balanced cylinders positioned axially centrally in the tool holder and two mass balanced pistons in the cylinders whose piston rods are attached centrally to the crosstie bars.

4 Claims, 2 Drawing Sheets

GRINDER, ESPECIALLY A HIGH PRECISION GRINDER, FOR A BEARING RING

FIELD OF THE INVENTION

Our present invention relates to a grinder for a bearing ring and, more particularly, to a high precision grinder for a bearing ring which has a race which is curved in cross section.

BACKGROUND OF THE INVENTION

A grinder, especially a high precision grinder, for a bearing ring can have a ball-bearing race having a curved cross section is known comprising at least one tool support and at least one tool holder.

The tool holder is supported in the tool support on two identical feed guide rods held by a crosstie bar.

The grinder also includes a feed piston cylinder device for a feed and a withdrawal motion for a tool which works on the bearing ring or the ball-bearing race.

The tool support with the tool holder is oscillatable to and fro about a substantially central oscillation axis through the tool support which provides the tool being used mounted in the working position with a to and fro pivoting motion rotating substantially about the center of curvature of the curved cross section of the race.

Particularly our invention is relevant to a high precision grinder for a ball-bearing race with a ball groove curved in cross section. Of course the feed piston cylinder device provides the necessary pressing force for working the bearing ring. Grinding machines in which the tool performs the described pivoting motion when a ball-bearing race or a ball bearing outer ring is worked are described in a variety of German Patents, e.g. German patent Nos. 17 52 064 and/or 17 52 520.

In practice in the known grinders the feed guide rods are only held on one side by one crosstie bar. The feed piston cylinder device is eccentrically connected to this crosstie bar directed away from the tool holder. A considerable inertial force which causes a disturbing vibration and which can impair the precision of the grinding arises with the pivoting motion. The uniformity of the machined cross section can be adversely effected.

OBJECTS OF THE INVENTION

It is an object of our invention to provide an improved grinding machine or grinder, especially a high precision grinder.

It is also an object of our invention to provide an improved grinder, especially a high precision grinder, in which a disturbing vibration as a result of the motion of the tool support or the tool holder no longer occurs.

It is another object of our invention to provide an improved grinder, especially a precision grinder, in which the precision of the grinding operation is improved.

SUMMARY OF THE INVENTION

These objects and others which will become more readily apparent hereinafter are attained in accordance with our invention in a grinder, especially a high precision grinder, or a bearing ring which has a ball-bearing race having a curved cross section comprising at least one tool support and at least one tool holder.

The tool holder is supported in the tool support on two equal feed guide rods held by a crosstie bar. The grinder also includes a feed piston cylinder device for a feed and a withdrawal motion for a tool which works on the bearing ring or the ball-bearing race.

The tool support with the tool holder is oscillatable to and fro about a substantially central oscillation axis through the tool support which provides the tool mounted on the tool holder in a working position with a to and fro pivoting motion rotating substantially about the center of the curved cross section of the race.

According to our invention at least one of the crosstie bars is provided at each end of the feed guide rods holding the feed guide rods so that the crosstie bars are mass balanced in regard to the pivoting motion and the feed piston cylinder device comprises two mass balanced cylinders positioned axially centrally in the tool holder and two mass balanced pistons in the cylinders whose piston rods are attached centrally to the crosstie bars.

Advantageously the crosstie bars are interiorly linear and parallel to each other and to the tool support but have an exteriorly curved shape which is part of a common curved outer casing. The tool support and the tool holder can have a plurality of pressurized medium ducts positioned so as to be mass balancing. The pressurized medium feed is effected by tubing which is easily deformable, which does not impair the kinematics or motions of the assembly and which if possible is guided so as to be mass balancing.

Our invention is based on the fact that the tool support in the grinding machine can be mass balanced by a second crosstie bar and simultaneously stabilized. The feed piston cylinder device can be mass balanced also.

Of course the tool holder in the working position takes a position to which the mass balancing relates and is facilitated as much as possible. This of course is hindered by an off -center shift which develops as the tool works. However this off-centering is small and does not lead to a disturbing oscillation. It is particularly advantageous that the oscillation frequency can be increased and consequently a higher rate of removal of material per unit time attained. Thus the running time or the cycle time can be reduced. As a result the capacity of the grinder is improved.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
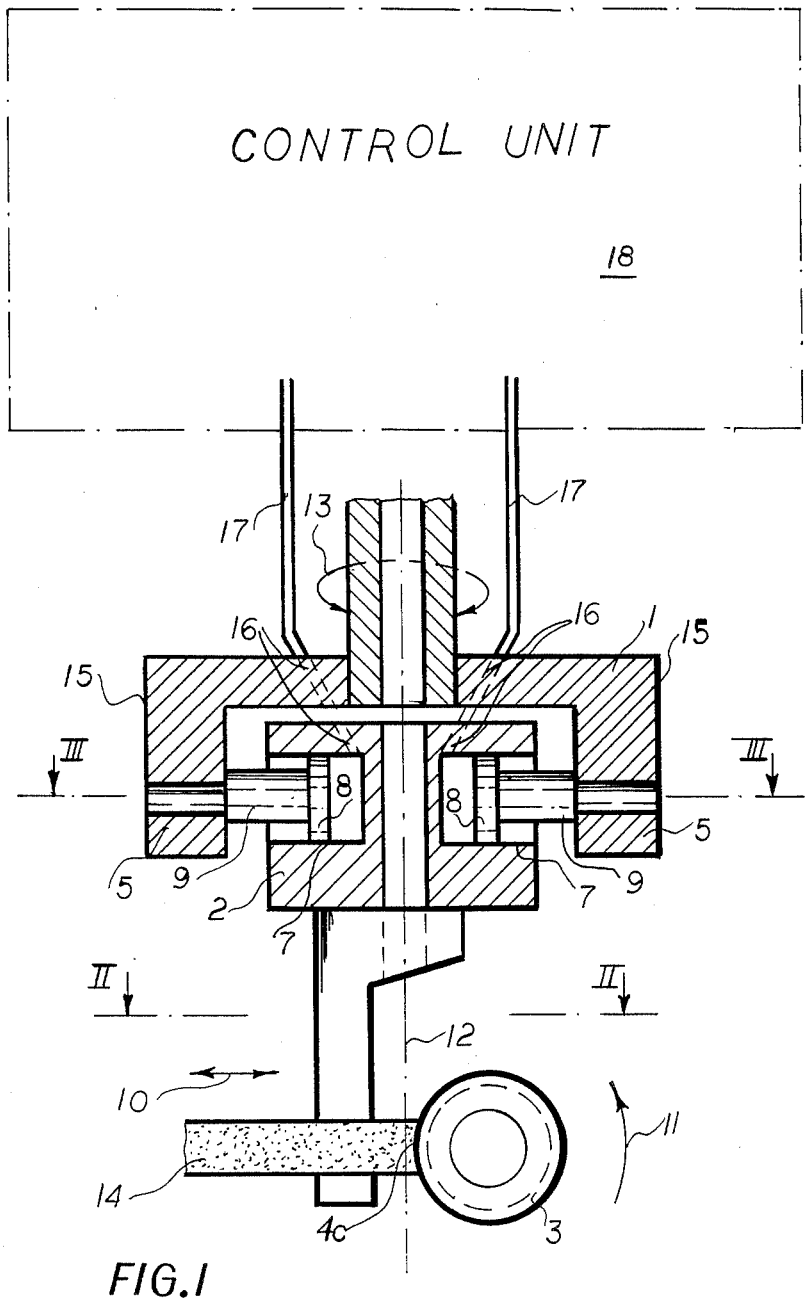
FIG. 1 is a cross sectional view of a portion of a grinder with a tool support and a tool holder according to our invention.

The tool support 1 with the tool holder 2 shown in the drawing is part of a grinder which is designed for working a ball bearing ring 3 which has a ball groove 4 with a circular cross section. FIGS. I and 2 show the bearing ring 3. While the grinder works on it, the bearing ring workpiece rotates. This is particularly relevant to a high precision grinder for such bearing rings 3.

The grinder according to our invention has at least one tool support 1 as does this example and at least one tool holder 2 as does this example also.

The tool holder 2 is supported on two equal feed guide rods 6 held by two crosstie bars 5 with one crosstie bar 5 at each opposite end of the feed guide rods and is provided with a feed piston cylinder device (see below) for a feed and withdrawal motion.

In FIG. 1 the double-headed arrow 10 shown on the left of the figure indicates the feed and withdrawal motion. The curved arrow 11 in FIG. 1 indicates the rotation of the ball bearing ring 3.

Figure 2:
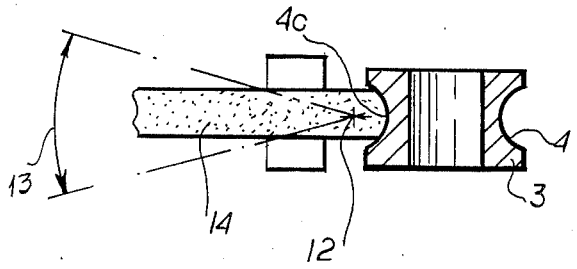
FIG. 2 is a cross sectional view of the device shown in FIG. 1 taken along the section line II—II ad seen in the direction of the arrows.

The tool support 1 with the tool holder 2 is oscillated about a substantially central oscillation axis 12 running through the tool support cross section. That oscillatory motion is indicated by the double-headed arrow 13 in FIG. 1. It provides the tool being used 14, i.e. the grinding stone, mounted in its working position with a to and fro pivoting motion rotating substantially about the center 4c of the circular cross section of the ball groove 4. That is shown by the double-headed arrow 13 in FIGS. 2 and 3.

Figure 3:
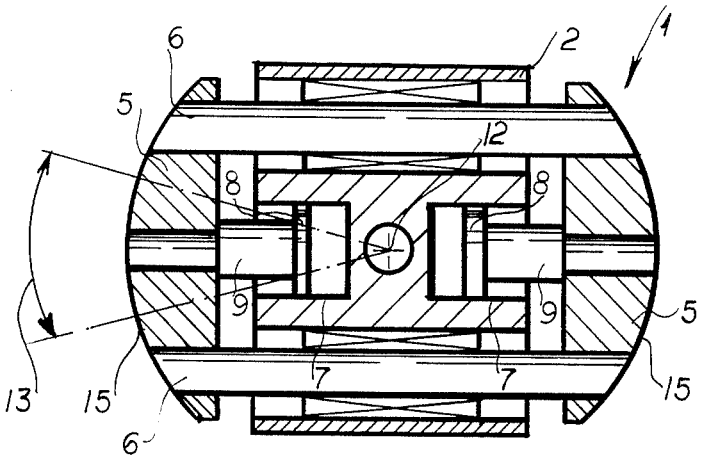
FIG. 3 is a cross sectional view of the device shown in FIG. 1 taken along the section line III—III and seen in the direction of the arrows.

From FIGS. 1 and 3 it can be seen that the feed guide rods 6 are held at both ends by two cross tie bars 5 which are mass balanced in regard to the oscillatory motion.

Furthermore the feed piston cylinder device comprises two mass balanced pistons 8 located centrally in the tool holder 2 in cylinders 7 whose piston rods 9 are mounted centrally in the crosstie bars 5. The tool support 1 and the tool holder 2 are usually formed mass balanced in regard to the remaining mass distribution.

The crosstie rods 5 are interiorly linear and parallel to each other and to the tool holder 2 in the cross section of the tool support 1, but have an exteriorly curved shape 15 which is part of a common circular outer casing.

The tool support 1 and the tool holder 2 have as is indicated in FIG. 1 pressurized medium ducts 16 located to balance mass. The pressurized medium ducts 16 are connected with a control unit 18 by connecting tubes 17.

We claim:

1. In a grinder, especially a high precision grinder, for a bearing ring which has a race with a curved cross section comprising at least one tool support and at least one tool holder, said tool holder being supported in said tool support on two equal feed guide rods held by a crosstie bar, and a feed piston cylinder device for a feed and a withdrawal motion, said tool support with said tool holder being oscillatable to and fro about a substantially central oscillation axis through said tool support which provides a tool mounted in said tool holder in a working position with a to and fro pivoting motion rotating substantially about the center of said curved cross section of said race, the improvement wherein at least one of said crosstie bars is provided at each end of said feed guide rods holding said feed guide rods so that said crosstie bars are mass balanced in regard to said pivoting motion and said feed piston cylinder device comprises two mass balanced cylinders positioned axially centrally in said tool holder and two mass balanced pistons in said cylinders whose piston rods are attached centrally to said crosstie bars.

2. The grinder defined in claim 1 wherein said crosstie bars have inwardly facing linear surfaces parallel to said axis but have an exteriorly curved shape which is a part of a common curved outer casing.

3. The grinder defined in claim 1 wherein said tool support and said tool holder have a plurality of pressurized medium ducts located as to be in balance about said axis.

4. A grinder, especially a high precision grinder, for grinding a ball-bearing ring which has a race with a curved cross section, said grinder comprising:

a tool support pivotable about an axis of oscillation, said tool support comprising:

two identical elongated and spaced apart feed guide rods terminating at opposite ends of said support, said feed guide rods being parallel to one another and extending perpendicular to said axis of oscillation on opposite sides thereof, a respective pair of mutually parallel crosstie bars, each of said crosstie bars being connected with each of said guide rods at opposite ends thereof and having inwardly facing linear surface generally parallel to said axis of oscillation;

a respective pair of mutually aligned piston and cylinder units, each comprising a cylinder with a corresponding piston movable back and forth perpendicular to said axis of oscillation, each of said piston and cylinder units being connected to the inner surface of the respective crosstie bar at the respective inner surface thereof; and at least one oscillatable holder coaxial with said tool support in a certain position, said holder receiving said piston and cylinder units and having a tool axially spaced from said tool support oscillatable substantially about a center of the curved cross-section of the ball-bearing ring, so that said crosstie bars and said piston and cylinder units have their mass equally distributed about said axis of oscillation in the certain position of said holder.

* * * * *